US007958911B2

(12) United States Patent
Martus

(10) Patent No.: US 7,958,911 B2
(45) Date of Patent: Jun. 14, 2011

(54) SHIPPING PLUG

(75) Inventor: Charles Robert Martus, Oxford, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/491,389

(22) Filed: Jun. 25, 2009

(65) Prior Publication Data

US 2010/0326556 A1 Dec. 30, 2010

(51) Int. Cl.
*F16L 55/10* (2006.01)
*B65D 59/02* (2006.01)

(52) U.S. Cl. ..... 138/89; 138/90; 215/295; 215/296; 215/355; 220/801; 220/789; 220/793

(58) Field of Classification Search ..... 138/89, 138/90, 96 R; 215/295–298, 301–303; 220/799–801
See application file for complete search history.

(56) References Cited

U.S. PATENT DOCUMENTS

| | | | | | |
|---|---|---|---|---|---|
| 77,559 | A | * | 5/1868 | Brown et al. | 215/292 |
| 572,951 | A | * | 12/1896 | Bernardin | 215/296 |
| 684,799 | A | * | 10/1901 | Devoe | 215/302 |
| 871,697 | A | | 11/1907 | Hofheimer | |
| 1,037,751 | A | * | 9/1912 | Gardner | 215/296 |
| 1,393,925 | A | | 10/1921 | Townsend | |
| 2,746,632 | A | | 5/1956 | Bramming | |
| 3,695,478 | A | * | 10/1972 | Sie et al. | 604/200 |
| 3,811,590 | A | * | 5/1974 | Hall, Jr. | 215/207 |
| 3,842,790 | A | | 10/1974 | Clark | |
| 4,098,417 | A | * | 7/1978 | Bennett | 215/204 |
| 4,399,927 | A | | 8/1983 | Yaotani et al. | |
| 4,460,087 | A | | 7/1984 | DeMarco et al. | 138/89 |
| 4,547,417 | A | | 10/1985 | DeMarco et al. | 428/66.3 |
| 4,576,595 | A | * | 3/1986 | Aas et al. | 604/256 |
| 4,691,839 | A | | 9/1987 | Ullman | |
| 4,893,636 | A | * | 1/1990 | Cook et al. | 600/577 |
| D311,056 | S | | 10/1990 | Patterson | |
| 5,024,345 | A | | 6/1991 | Deweerdt | |
| 5,060,659 | A | * | 10/1991 | Cook et al. | 600/577 |
| 5,578,491 | A | * | 11/1996 | Kayal et al. | 435/288.1 |
| 5,803,126 | A | * | 9/1998 | Zaro | 138/89 |
| 6,082,410 | A | | 7/2000 | Pohar | 206/415 |
| 2006/0081300 | A1 | | 4/2006 | Schmalz | |
| 2008/0092977 | A1 | | 4/2008 | Zeyfang | |

FOREIGN PATENT DOCUMENTS

| | | |
|---|---|---|
| DE | 9116100.2 | 2/1992 |
| DE | 102004049032 | 4/2006 |
| EP | 1284231 | 2/2003 |
| FR | 2453789 | 11/1980 |
| JP | 9272552 | 10/1997 |

* cited by examiner

OTHER PUBLICATIONS

International Search Report for Application No. PC1/1B2010/001518 dated Nov. 11, 2010 (13 pages).

*Primary Examiner* — Patrick F Brinson
(74) *Attorney, Agent, or Firm* — Dierker & Associates, P.C.

(57) ABSTRACT

A shipping plug is disclosed herein. The shipping plug is formed from a cylindrical member that is configured to be operatively disposed within a bore of a component to create a seal therewith. The cylindrical member is a resilient material, and has an upper wall, a lower wall, and a circumferential side defined between the upper and lower walls. A recess is defined in the upper wall. The recess includes a bottom end and at least one wall extending between the bottom end and the upper wall. The recess is configured to operatively receive a complementarily shaped rod which selectively distorts the circumferential side of the cylindrical member in response to a twisting or rotating action exerted thereon to temporarily release the seal.

19 Claims, 4 Drawing Sheets

SHIPPING PLUG

BACKGROUND

The present disclosure relates generally to a shipping plug.

Shipping plugs are often used when lubricated components are being transported from one location to another. One example of such a component is a differential, which includes valve bores having oil therein. Traditional shipping plugs used with such valve bores may be vented to allow pressure, which may result from the plug insertion, to escape. Such venting is desirable in order to prevent excess pressure from building within the valve bore.

SUMMARY

A shipping plug is disclosed herein. The shipping plug is formed from a cylindrical member that is configured to be operatively disposed within a bore of a component to create a seal therewith. The cylindrical member is a resilient material, and has an upper wall, a lower wall, and a circumferential side defined between the upper and lower walls. A recess is defined in the upper wall. The recess includes a bottom end and at least one wall extending between the bottom end and the upper wall. The recess is configured to operatively receive a complementarily shaped rod which selectively distorts the circumferential side of the cylindrical member in response to a twisting or rotating action exerted thereon to temporarily release the seal.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

A shipping plug according to embodiment(s) disclosed herein advantageously releases excess pressure from within a corresponding bore, substantially without contaminating the interior fluid or altering the surface and/or inner diameter of the bore of the component being plugged.

Figure 1:
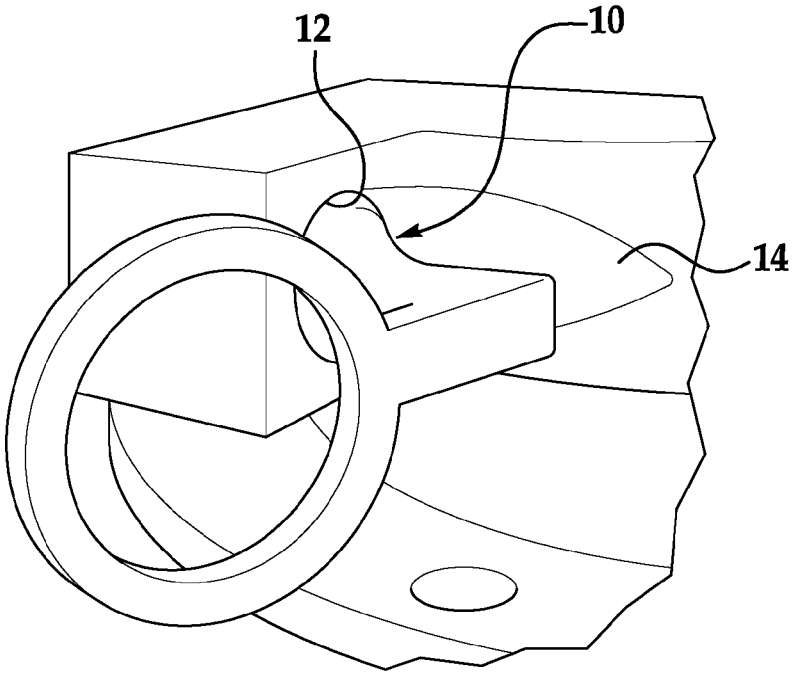
FIG. 1 is a cut-away perspective view of an embodiment of a shipping plug in a bore of a differential.

Referring now to FIG. 1, a cut-away perspective view of an embodiment of a shipping plug 10 disposed within in a bore 12 of a differential 14 is depicted. The shipping plug 10 is used to seal the bore 12 of the differential 14, thereby maintaining oil within the bore 12. It is to be understood that the shipping plug 10 may be configured to be used in the bore 12 of other components (e.g., pipes, tubes, etc.) that are used for shipping fluids, and are particularly desirable when such components are in transit. The details of the various embodiments of the shipping plug 10 are discussed further in reference to FIGS. 2A, 2B, 3, and 5.

Referring now to FIGS. 2A, 2B, 3, and 5 together, the shipping plug 10, 10', 10", 10'", respectively, includes a cylindrical member 16 having a recess 18 defined therein. As discussed further hereinbelow, the recess 18 may be a cylindrical conical recess 22 (shown in FIG. 3), a conical or substantially cone shaped recess 23 (shown in FIG. 5), or a slotted recess 20 (shown in FIGS. 2A and 2B) defined therein. The cylindrical member 16 may be made of any suitable material that is capable of forming a seal with the bore 12 into which it is disposed. Non-limiting examples of such materials include resilient materials, such as SANTOPRENE™ (commercially available from ExxonMobil Chemical), polyamides, and/or other like polymeric materials.

The cylindrical member 16 is operatively configured to be disposed within a bore 12, thereby creating a seal at the end 24 of the bore 12. The seal advantageously prevents oil (or some other fluid) from leaking out of the bore 12 when the component 14 is in transit.

One embodiment of the cylindrical member 16 includes a closed upper wall 26, a lower wall 28 opposed to the upper wall 26, and a circumferential side 30 therebetween. In some instances, the circumferential side 30 may include at least some circumferential ribbing to improve its ability to seal with a bore 12. The upper and lower walls 26, 28 may be configured horizontally, or in another other direction suitable for sealing a desirable bore 12. The embodiment of the shipping plug 10 shown in FIG. 2A includes a closed lower wall 28. As such, this embodiment of the cylindrical member 16 is a solid cylindrical component. However, it is also to be understood that in another embodiment of the shipping plug 10' (as shown in FIG. 2B), the lower wall 28 may have an opening or recess 34 formed therein. This recess 34 reduces the amount of material used to form the shipping plug 10', imparts at least some flexibility to the shipping plug 10' when pressure is released from the corresponding bore, and reduces the weight of the shipping plug 10', while still enabling the shipping plug 10' to contact the bore 12 along the circumferential side 30 of the cylindrical member 16.

As previously mentioned, the embodiments of the shipping plug 10, 10', 10", 10'" disclosed herein include the recess 18 defined in the upper wall 26 and through a predetermined depth of the cylindrical member 16. Both embodiments 20, 22, 23 of the recess 18 include a bottom end 36 and one or more walls 27 that is/are substantially perpendicular or at some other desirable angular orientation relative to the orientation of the upper wall 26. In the embodiment shown in FIGS. 2A, 2B and 3, the upper wall 26 is horizontal, and the wall(s) 27 is/are vertical. In the embodiment shown in FIG. 5, the upper wall 26 is horizontal, and the wall 27' is conical shaped. The wall(s) 27, 27' extend between the bottom end 36 and the upper wall 26. The recess 18 terminates within the cylindrical member 16 at the bottom end 36.

Figure 2A:
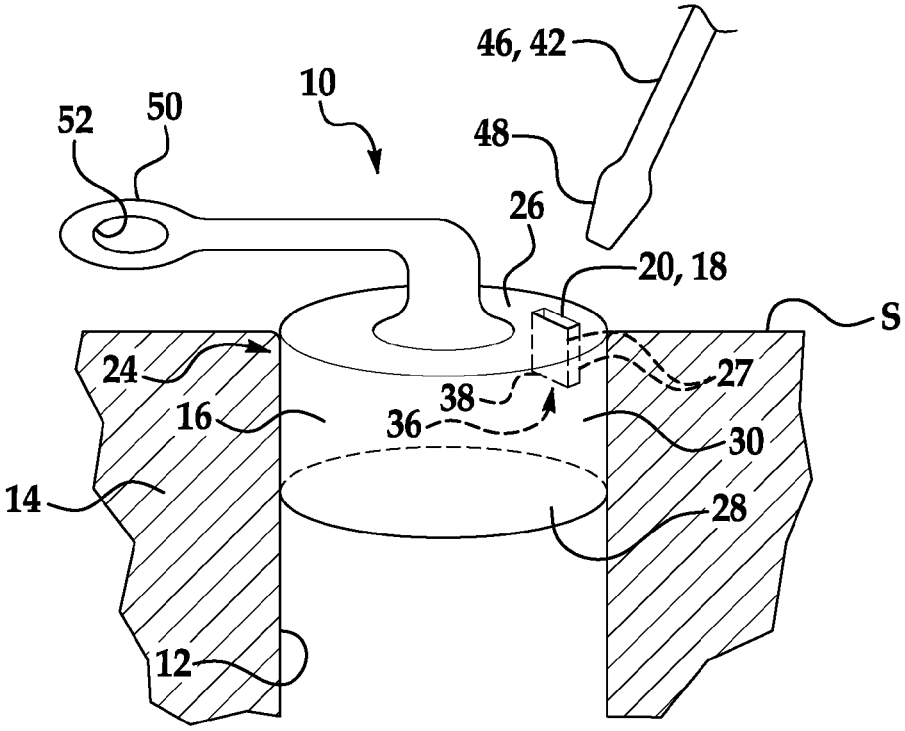
FIG. 2A is a cut-away, partially cross-sectional and partially perspective view of an embodiment of the bore with the shipping plug having a slotted recess and a closed lower wall.
Figure 2B:
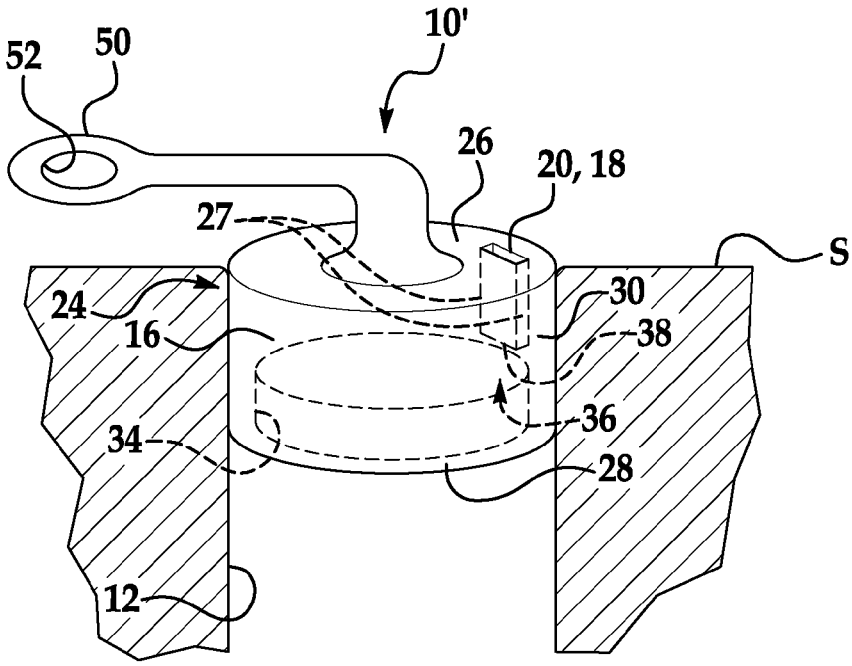
FIG. 2B is a cut-away, partially cross-sectional and partially perspective view of an embodiment of the bore with the shipping plug having a slotted recess and an open lower wall.

As shown in FIGS. 2A and 2B, the slotted recess 18, 20 is defined in the cylindrical member 16. In these embodiments, the bottom end 36 of the slotted recess 18, 20 may consist of a bottom wall 38. The slotted recess 18, 20 is defined by the bottom wall 38 and four substantially vertical walls 27 extending between the bottom wall 38 and the upper wall 26. In the examples shown in FIGS. 2A and 2B, the slotted recess 18, 20 is rectangular.

Figure 3:
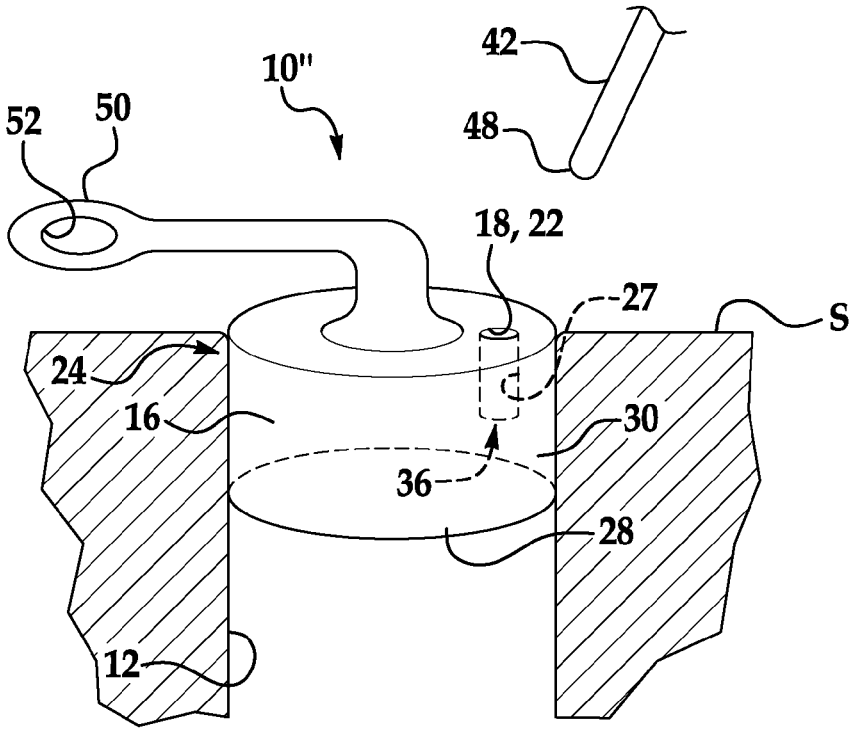
FIG. 3 is a cut-away, partially cross-sectional and partially perspective view of an embodiment of the bore with the shipping plug having an open recess and a closed lower wall.
Figure 5:
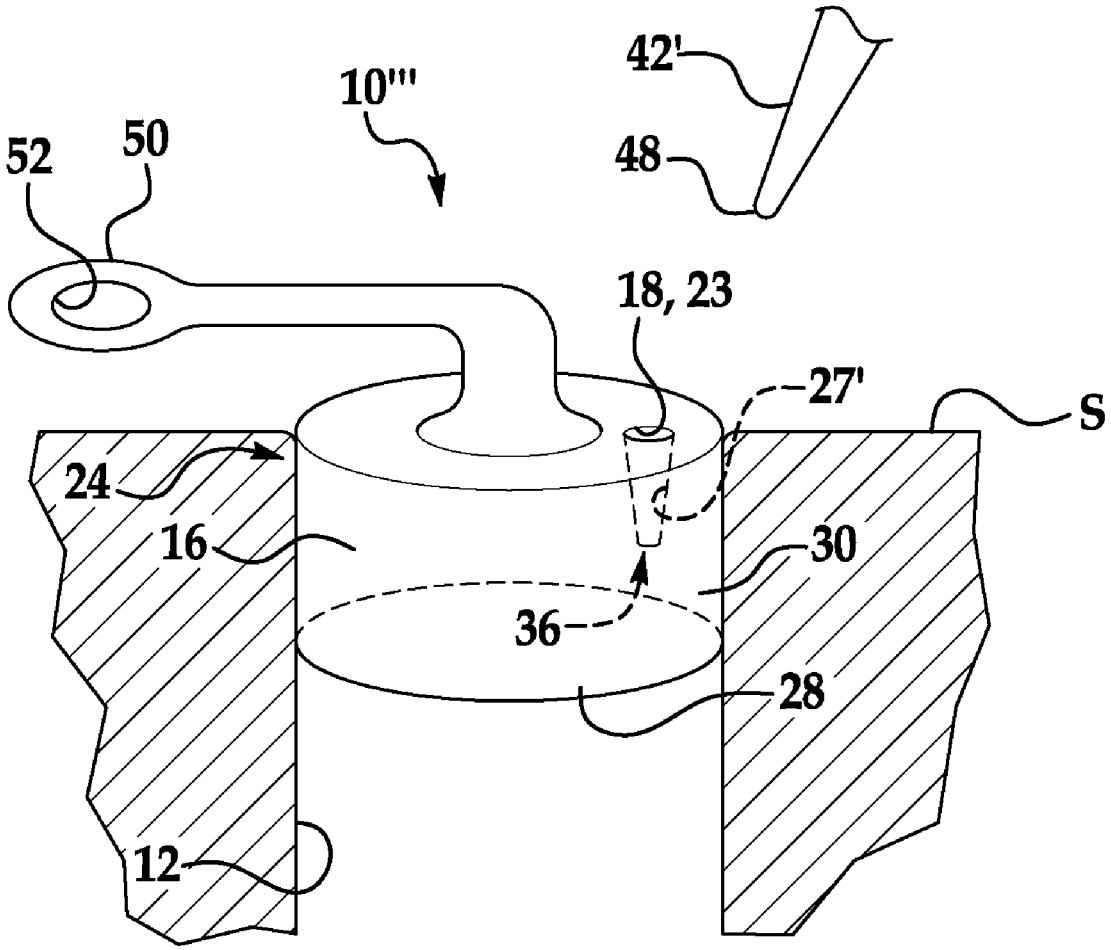
FIG. 5 is a view similar to that of FIG. 3, but showing a conical shaped recess.

As shown in FIG. 3, the cylindrical recess 18, 22 is defined in the cylindrical member 16. The cylindrical recess 18, 22 is also defined by a single cylindrical shaped wall 27. As shown in FIG. 5, the conical shaped recess 18, 23 is defined in the cylindrical member 16. The conical shaped recess 18, 23 is defined by a single conical shaped wall 27'.

It is also to be understood that the recess 18 may be formed in any desirable location in the upper wall 26, except at a position in which the recess 18 would intersect with the circumferential side 30 of the shipping plug 10, 10', 10", 10'". As previously indicated, the circumferential side 30 creates the seal between the shipping plug 10, 10', 10", 10'" and the bore 12, and thus it would be undesirable to create the recess 18 directly in contact with the circumferential side 30. The position of the recess 18 is i) far enough from the circumferential side 30 so that the side 30 remains capable of creating the seal when inserted into the bore 12, but is ii) close enough to the circumferential side 30 so as to be able to receive a rod 42 (described further hereinbelow) and distort the circumferential side 30 in response to motion of the rod 42 within the recess 18.

The embodiments 20, 22, 23 of the recess 18 are configured to operatively receive a complementarily shaped pressure removal rod 42, or other like pressure removal tool or member. The rod 42 engages the recess 18, and is twisted or rotated to distort the circumferential side 30 of the cylindrical member 16. As the circumferential side 30 of the cylindrical member 16 is distorted, the seal between the circumferential side 30 and the bore 12 is disrupted, thereby allowing excess pressure to escape from the bore 12. Since the rod 42 does not directly contact the bore 12, it is believed that this method/system enables the release of pressure without damaging the inner walls of the bore 12. Furthermore, the rod 42 does not come into contact with the oil, lubricant or other fluid housed within the bore 12 during this pressure relieving process. Accordingly, the rod 42 does not contaminate the oil, lubricant or other fluid.

As shown in FIG. 2A, the rod 42 may be a screwdriver 46, which is particularly suitable for engaging the slotted recess 18, 20. In this example, the screwdriver 46 is inserted into the slotted recess 18, 20. The screwdriver 46 may then be rotated or twisted within the slotted recess 18, 20, either within the plane of the upper wall 26 (e.g., horizontally) or out of the plane of the upper wall 26 to distort the circumferential side 30 of the cylindrical member 16. As previously mentioned, the seal between the circumferential side 30 of the cylindrical member 16 and the bore 12 is opened when the circumferential side 30 is distorted. This allows excess pressure to escape without damaging the inner diameter of the bore 12. When the screwdriver 46 is removed from the slotted recess 18, 20, the resilient shipping plug 10 returns to its original state, and this recreates the seal between the circumferential side 30 and the bore 12. As a result of this process, the excess pressure has been removed from within the bore 12, and the re-instated seal between the shipping plug 10 and the bore 12 prevents the fluid from leaking out of the bore 12.

FIG. 3 depicts the removal rod 42 having a cylindrical shape corresponding with the shape of the recess 18, 22. FIG. 5 depicts the removal rod 42' having a conical shape corresponding to the shape of the recess 18, 23. The removal rod 42, 42' also includes a rounded tip. As such, the embodiments of the removal rod 42 include a remote end 48 which is shaped to be operatively received by the corresponding recess 18, 20, 22, 23.

The cylindrical member 16 of the various embodiments of the shipping plug 10, 10', 10", 10'" may be disposed such that it is positioned entirely within the bore 12 of the component 14, as shown in FIGS. 2A, 2B, 3, and 5 in order to seal the bore 12 of the component 14 and to prevent leakage of the fluid during the shipping process. In other instances, however, it may be desirable that a portion of the cylindrical member 16 remain slightly above an outer surface S of the component 14.

Generally, the resilient cylindrical member 16 includes a circumference that is substantially equal to the inner diameter of the bore 12. This enables the shipping plug 10, 10', 10", 10'" to be inserted into an end 24 of the bore 12 while simultaneously creating the seal.

It is to be understood that any embodiments of the shipping plug 10, 10', 10", 10'" may include a handle 50 formed integrally with or otherwise attached to the cylindrical member 16, as shown in FIGS. 2A, 2B, 3, and 5. The handle 50 may extend out of the upper wall 26 of the shipping plug 10, 10', 10", 10'". The handle 50 provides an area of the plug 10, 10' 10", 10'" that may be grasped by a user when inserting and/or removing the shipping plug 10, 10', 10", 10'" into and/or from the bore 12. In some embodiments, the handle 50 includes an aperture 52 which is believed to enhance the gripping ability of the shipping plug 10, 10', 10", 10'".

The shipping plug 10, 10', 10", 10'" disclosed herein may be manufactured via any suitable molding process, including compression molding, injection molding, or the like.

Figure 4A:
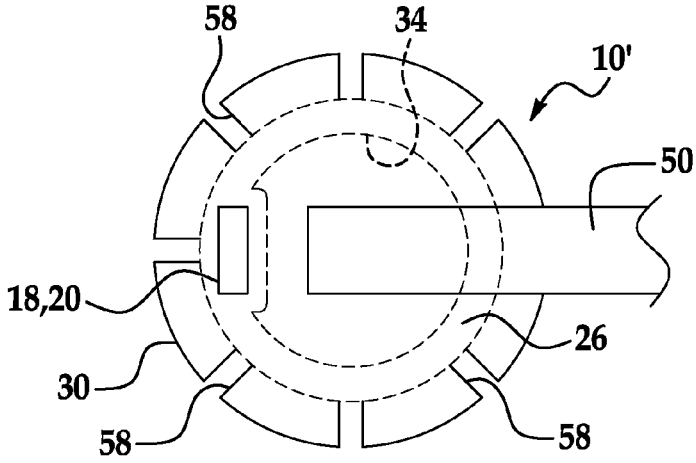
FIG. 4A is a top view of yet another embodiment of the shipping plug, which includes a slotted recess.
Figure 4B:
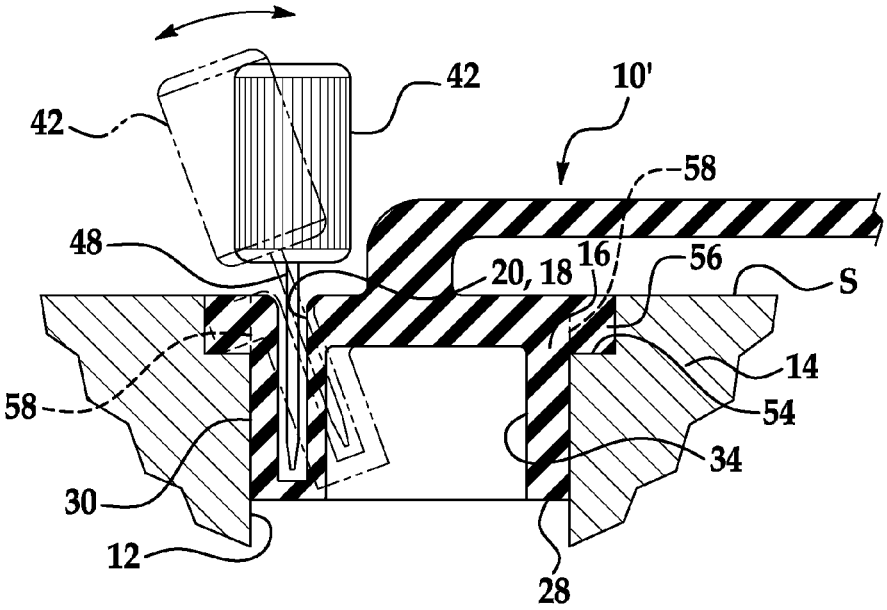
FIG. 4B is a cross-sectional view of the embodiment of FIG. 4A illustrating the shipping plug disposed within a bore, and the vented and unvented positions of the shipping plug.
Figure 4C:
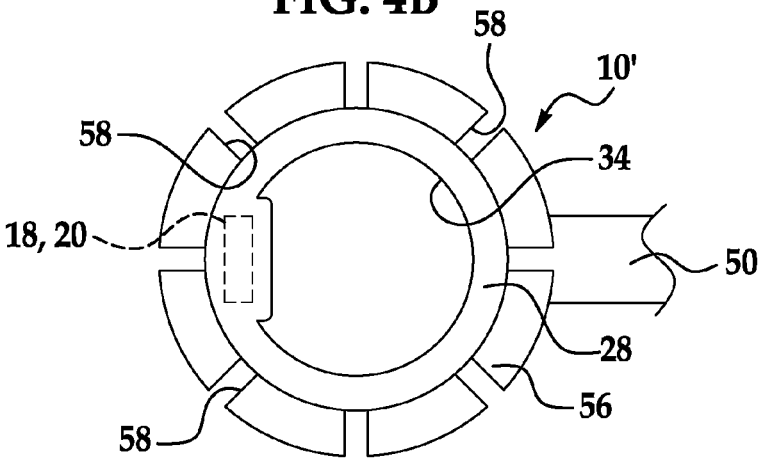
FIG. 4C is a bottom view of the embodiment of FIG. 4A.

Referring now to FIGS. 4A, 4B, and 4C together, various views of another embodiment of the shipping plug 10', including the slotted recess 18, 20 defined in the upper wall 26 and the recess 34 defined in the lower wall 28, is depicted. FIG. 4A illustrates a top view of the shipping plug 10', including the handle 50 and the slotted recess 18, 20, while FIG. 4C illustrates a bottom view of the shipping plug 10'.

Referring specifically to FIG. 4B, the rod 42 is shown engaged in the slotted recess 18, 20. Furthermore, the shipping plug 10' is shown both in the non-vented or sealed position (in solid lines), and in the vented position (in phantom lines) where the circumferential wall 30 is spaced away from the bore 12.

In the embodiment shown in FIG. 4B, the component 14 also has a shelf 54 formed at its surface S and adjacent to the bore 12. This shelf 54 engages a portion of the shipping plug 10, 10', 10", 10'" when in the sealed position. The shelf 54 also limits an insertion depth of the plug 10, 10', 10", 10'" when the plug 10, 10', 10", 10'" is installed. The shipping plug 10' is inserted into the bore 12 at a desirable insertion depth, e.g., as shown in FIG. 4B. As such, in this embodiment, the shipping plug 10' includes a complementarily shaped flange 56 that contacts the shelf 54 of the component 14. The flange 56 at least partially circumscribes a periphery of the upper wall 26. The flange 56 may include one or more seal-preventing formations 58 formed thereon or therein to prevent the flange 56 from forming a secondary seal with the shelf 54, thereby allowing venting when the plug 10, 10', 10", 10'" is manipulated to release pressure. As an illustrative, non-limitative example, the seal-preventing formations 58 are shown in FIGS. 4A, 4B and 4C as slots. However, it is to be understood that the seal-preventing formation(s) 58 may be groove(s), bump(s), ridge(s), and/or the like. The seal-preventing formation(s) 58 interrupt sealing contact between the flange 56 and the shelf 54.

Embodiments of the shipping plug 10, 10', 10", 10'" disclosed herein include, but are not limited to, the following advantages. The shipping plug 10, 10', 10", 10'" generally prevents leaking of the contents within the bore 12 while enabling pressure built up within the bore 12 to be vented. The pressure releasing system disclosed herein also reduces the likelihood that the plug will dislodge during shipping. Still further, the method disclosed herein does not require plastic rods or other like tools to be inserted between the plug 10, 10', 10", 10'" and the inner diameter of the bore 12. This advantageously reduces or eliminates i) damage to the inner diameter of the bore 12 as a result of contact with such rods, ii) any deleterious effect on the operation of the components which may result from such contact with the rod, and iii) any contamination or debris introduced into the bore from such rods.

While several embodiments have been described in detail, it will be apparent to those skilled in the art that the disclosed embodiments may be modified. Therefore, the foregoing description is to be considered exemplary rather than limiting.

What is claimed is:

1. A shipping plug, comprising:

a cylindrical member configured to be operatively disposed within a bore of a component to create a seal therewith, the cylindrical member including a resilient material, and having an upper wall, a lower wall, and a circumferential side defined between the upper and lower walls;

a handle integrally formed with or operatively attached to the upper wall, the handle extending out of the upper wall and having an aperture formed at an end distal to the cylindrical member; and a recess defined in the upper wall, the recess including a bottom end and at least one wall extending between the bottom end and the upper wall, the recess being configured to operatively receive a complementarily shaped rod which selectively distorts the circumferential side of the cylindrical member in response to a twisting or rotating action exerted thereon to temporarily release the seal without removing the cylindrical member from the bore.

2. The shipping plug as defined in claim 1, further comprising an other recess defined in a lower wall of the cylindrical member.

3. The shipping plug as defined in claim 1 wherein the recess has a conical configuration, and wherein the bottom wall is smaller than an opening of the recess.

4. The shipping plug as defined in claim 1 wherein the resilient material is a polymeric material.

5. The shipping plug as defined in claim 1 wherein the recess has a slot configuration.

6. The shipping plug as defined in claim 1 wherein the recess has a cylindrical configuration, and wherein the bottom wall is rounded.

7. The shipping plug as defined in claim 1 wherein the recess is positioned a predetermined distance from the circumferential side.

8. The shipping plug as defined in claim 1 wherein the recess extends through a portion of a depth of the cylindrical member.

9. The shipping plug as defined in claim 1, further comprising a flange at least partially circumscribing a periphery of the upper wall, the flange including at least one flange-seal-preventing formation formed thereon or therein.

10. A sealing system, comprising:

a component having a bore formed therein;

a shipping plug, including:

a resilient cylindrical member configured to be operatively disposed within the bore of the component to create a seal therewith, the resilient cylindrical member including an upper wall, a lower wall, and a circumferential side defined between the upper and lower walls;

a handle integrally formed with or operatively attached to the upper wall, the handle extending out of the upper wall and having an aperture formed at an end distal to the cylindrical member; and a recess defined in the upper wall, the recess including a bottom end and at least one wall extending between the bottom end and the upper wall; and a pressure removal rod having a remote end configured to be operatively received by the recess, the pressure removal rod configured to selectively distort the circumferential side of the cylindrical member in response to a twisting or rotating action exerted thereon to temporarily release the seal without removing the cylindrical member from the bore.

11. The sealing system as defined in claim 10 wherein the cylindrical member is entirely disposed within the bore to create the seal.

12. The sealing system as defined in claim 10 wherein the recess is a slot and wherein the rod is a screw driver.

13. The sealing system as defined in claim 10 wherein the recess has a conical configuration, and wherein the bottom wall of the recess is smaller than an opening of the recess.

14. The sealing system as defined in claim 10 wherein the recess has a cylindrical configuration, and wherein the bottom wall is rounded.

15. The sealing system as defined in claim 10 wherein the upper wall is horizontally oriented with respect to a top surface of the component, and wherein the recess is vertically oriented with respected to the top surface of the component.

16. The sealing system as defined in claim 10, further comprising:

a shelf circumscribing an outer rim of the bore;

a flange i) at least partially circumscribing a periphery of the upper wall, and ii) being substantially complementarily-shaped with the shelf, the flange being configured to substantially prevent the shipping plug from being inserted into the bore beyond a desirable depth.

17. The sealing system as defined in claim 16 wherein the flange includes at least one seal-preventing formation disposed thereon or therein, the seal-preventing formation being configured to substantially prevent a seal from being formed between the flange and the shelf.

18. A shipping plug kit, comprising:

a cylindrical member configured to be operatively disposed within a bore of a component to create a seal therewith, the cylindrical member including a resilient material, and having an upper wall, a lower wall, and a circumferential side defined between the upper and lower walls;

a handle integrally formed with or operatively attached to the upper wall, the handle extending out of the upper wall and having an aperture formed at an end distal to the cylindrical member;

a recess defined in the upper wall, the recess including a bottom end and at least one wall extending between the bottom end and the upper wall; and a pressure removal rod having a remote end configured to be operatively received by the recess, the pressure removal rod configured to selectively distort the circumferential side of the cylindrical member in response to a twisting or rotating action exerted thereon to temporarily release the seal without removing the cylindrical member from the bore.

19. The shipping plug kits as defined in claim 18 wherein the recess is a slot and wherein the rod is a screw driver.

* * * * *